US006491235B1

(12) United States Patent
Scott et al.

(10) Patent No.: US 6,491,235 B1
(45) **Date of Patent: *Dec. 10, 2002**

(54) POP-UP SPRINKLER WITH TOP SERVICEABLE DIAPHRAGM VALVE MODULE

(75) Inventors: Loren W. Scott, Carlsbad; Phillip A. Hope, Escondido, both of CA (US)

(73) Assignee: Hunter Industries, Inc., San Marcos, CA (US)

( * ) Notice: Subject to any disclaimer, the term of this patent is extended or adjusted under 35 U.S.C. 154(b) by 12 days.

This patent is subject to a terminal disclaimer.

(21) Appl. No.: 09/659,977

(22) Filed: Sep. 12, 2000

Related U.S. Application Data

(63) Continuation-in-part of application No. 09/491,006, filed on Jan. 25, 2000, now Pat. No. 6,227,455, which is a continuation-in-part of application No. 09/094,412, filed on Jun. 9, 1998, now abandoned.

(51) Int. Cl.[7] ..... B05B 15/10
(52) U.S. Cl. ..... 239/206; 239/580
(58) Field of Search ..... 239/200–207, 239/569, 570, 571, 583, 590, 590.3, 590.5, 600, 580, 263.1; 251/46, 61.5, 363; 137/327, 328

(56) References Cited

U.S. PATENT DOCUMENTS 5,871,156 A 2/1999 Lawson ..... 239/201
5,899,386 A * 5/1999 Miyasato et al. ..... 239/206
6,227,455 B1 * 5/2001 Scott et al. ..... 239/206

* cited by examiner

*Primary Examiner*—Lisa A. Douglas
(74) *Attorney, Agent, or Firm*—Michael H. Jester

(57) ABSTRACT

A top serviceable pop-up sprinkler includes a main cylindrical outer housing having a female threaded inlet at a lower end thereof A spring biased tubular riser is mounted inside the outer housing for vertical reciprocation through an opening in an upper end of the outer housing. A nozzle is fixed in a nozzle head rotatably mounted at an upper end of the riser for ejecting a stream of water. The nozzle is rotated over an adjustable arc by a conventional turbine, gear drive and arc adjustable reversing mechanism. A valve actuator component assembly, including a pilot valve, solenoid and pressure regulator is mounted in a generally rectangular component housing that is connected to the side of the cylindrical outer housing. A lid of the component housing aligns with, and effectively forms a part of, a circular ground support flange that extends horizontally from the upper end of the outer housing. The riser opening is eccentrically located in the circular ground support flange. A diaphragm valve module is mounted in the lower end of the outer housing for controlling the flow of water through the inlet in response to the opening and closing of the solenoid actuated pilot valve. The diaphragm valve module is configured so that it is removable as a unit from the outer housing through the opening in the upper end of the outer housing upon extraction of the riser. Thus, when the diaphragm valve fails, as is often the case, the diaphragm valve module can be easily repaired or replaced after removing the riser, without having to dig up the sprinkler. The diaphragm valve module is releasably held in position in the lower end of the outer housing by a snap ring having a pair of peripheral annular portions that can be radially retracted by squeezing opposing tabs on a central resilient connecting portion.

20 Claims, 3 Drawing Sheets

POP-UP SPRINKLER WITH TOP SERVICEABLE DIAPHRAGM VALVE MODULE

CROSS-REFERENCE TO RELATED APPLICATIONS

This application is a continuation-in-part of U.S. patent application Ser. No. 09/491,006 filed Jan. 25, 2000 of Loren W. Scott and Phillip A. Hope, the entire disclosure of which is hereby incorporated by reference. Said application Ser. No. 09/491,006 is a continuation-in-part of now abandoned U.S. patent application Ser. No. 09/094,412 filed Jun. 9, 1998 now abandoned. Said application Ser. No. 09/491,006 issued as U.S. Pat. No. 6,227,455, granted May 8, 2001.

BACKGROUND OF THE INVENTION

The present invention relates to sprinklers used to irrigate lawns, playing fields, golf courses and the like, and more particularly, to an irrigation sprinkler that can be serviced from the top of the sprinkler without having to excavate the same.

Sprinklers have long been used to water turf and other vegetation. Many designs have been developed with the goal of uniformly distributing a desired precipitation rate over a given area. One of the most common type of sprinklers is the pop-up type that is normally mounted in a sub-surface location so that the top of the sprinkler is substantially at ground level. When water pressure is applied, a riser with a nozzle at its upper end extends and delivers a spray of water over the adjacent area. When the water pressure is terminated, a spring retracts the riser so that the upper end of the nozzle is flush with the head of the sprinkler. This removes the sprinkler as an obstacle to play occurring on the turf and allows the turf to be mowed.

So-called rotor type pop-up sprinklers having internal water turbines for rotating their nozzles have been developed and widely commercialized. Furthermore, pop-up sprinklers with diaphragm type valves incorporated into the same are widely utilized. A common type of pop-up sprinkler has an internal diaphragm valve which is opened and closed by a solenoid or a hydraulically operated pilot valve. The diaphragm valve controls the entry of water into the outer case or housing of the sprinkler from a pressurized supply pipe or line to which it is connected. In many cases during the life of a so-called "valve-in-head" sprinkler the diaphragm valve will fail, often due to debris damaging the diaphragm valve seat or clogging the small passages in the diaphragm valve. The thin flexible diaphragm may also wear out. It is then necessary to shut off the water supply and dig up the sprinkler so that the defective diaphragm valve components can be repaired, or the sprinkler replaced in its entirety. This is a relatively expensive, tedious and time consuming process. Excavation of the defective sprinkler can also cause considerable damage to the surrounding landscaping.

U.S. Pat. No. 5,871,156 of Lawson assigned to Anthony Manufacturing Corporation discloses an impact type pop-up sprinkler having a valve seat that is removable from the top of the sprinkler case, without disconnecting the case from the water supply. However, impact type sprinklers are noisy, inaccurate in terms of arc coverage, and prone to breakage. In addition, it is necessary to individually disassemble and reassemble the various components of the diaphragm valve in order to gain access to the valve seat which must be unscrewed from the outer case. This part-by-part disassembly and re-assembly can be a difficult task for landscape maintenance personnel who are often simply gardeners.

It would therefore be desirable to provide a pop-up sprinkler with a turbine driven rotor and a diaphragm valve assembly that could be more readily serviced from the top of the sprinkler without having to dig up or otherwise disconnect the sprinkler from its supply line.

SUMMARY OF THE INVENTION

It is therefore the primary object of the present invention to provide a rotor type pop-up sprinkler with a built-in diaphragm valve that can be readily accessed from the surface for repair or replacement.

According to the present invention a top serviceable pop-up sprinkler includes an outer housing having an inlet at a lower end thereof. A riser is mounted inside the outer housing for vertical reciprocation through an opening in an upper end of the outer housing. A nozzle is mounted in an upper end of the riser for ejecting a stream of water. At least one valve actuator component is connected to the outer housing. A diaphragm valve module is mounted in the lower end of the outer housing for controlling the flow of water through the inlet in response to actuation of the valve actuator component. The diaphragm valve module is configured so that it is removable as a unit from the outer housing through the opening in the upper end of the outer housing upon removal of the riser from the outer housing. Thus, when the diaphragm valve fails, as is often the case, the diaphragm valve module can be easily repaired or replaced after removing the riser, without having to dig up the sprier.

DESCRIPTION OF THE PREFERRED EMBODIMENT

Figure 1:
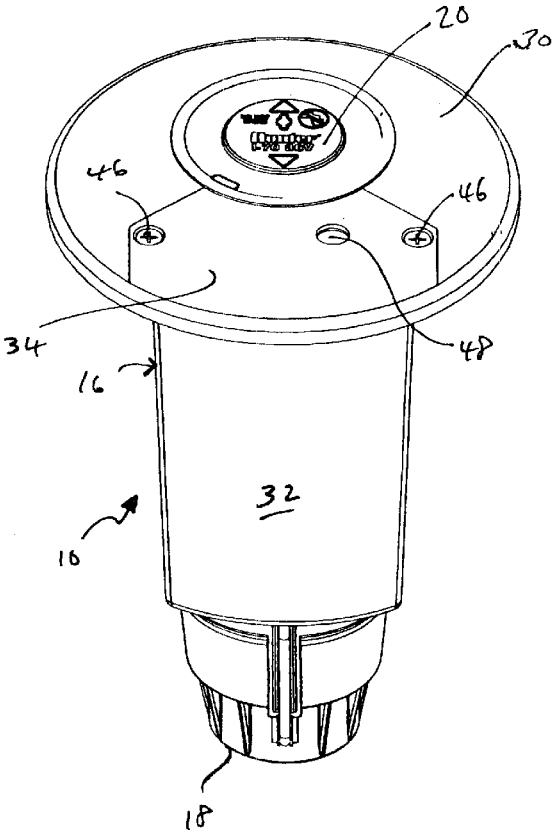
FIG. 1 is a perspective view of a first embodiment of a pop-up sprinkler incorporating a top serviceable valve module in accordance with a preferred embodiment of the present invention.
Figure 2:
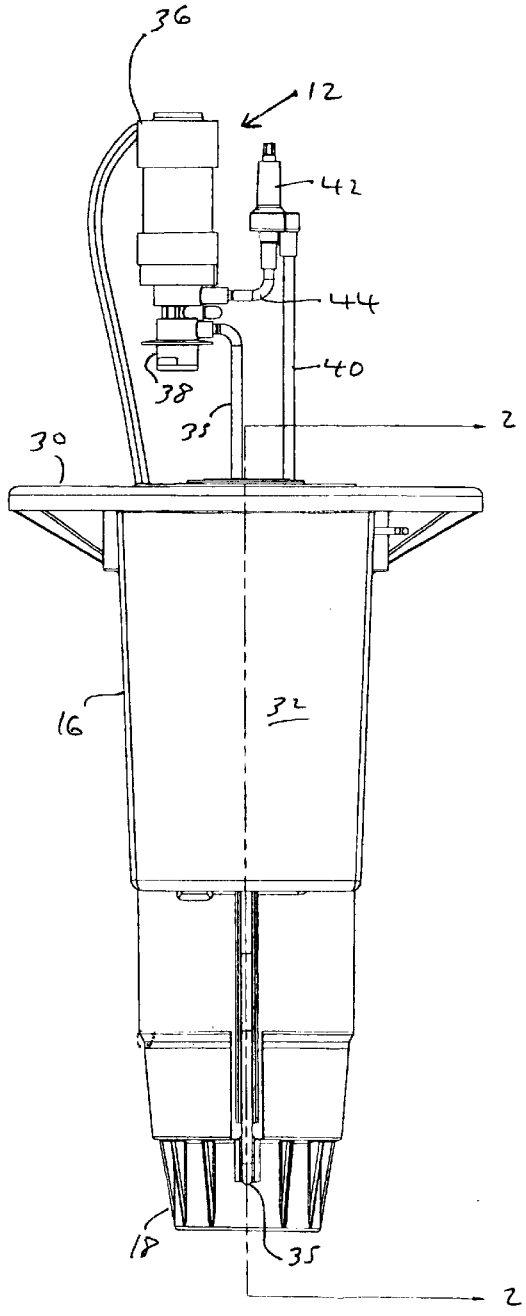
FIG. 2 is a side elevation view of the sprinkler of FIG. 1 showing its solenoid, pilot valve and pressure regulator pulled out of the top of the sprinkler.
Figure 4:
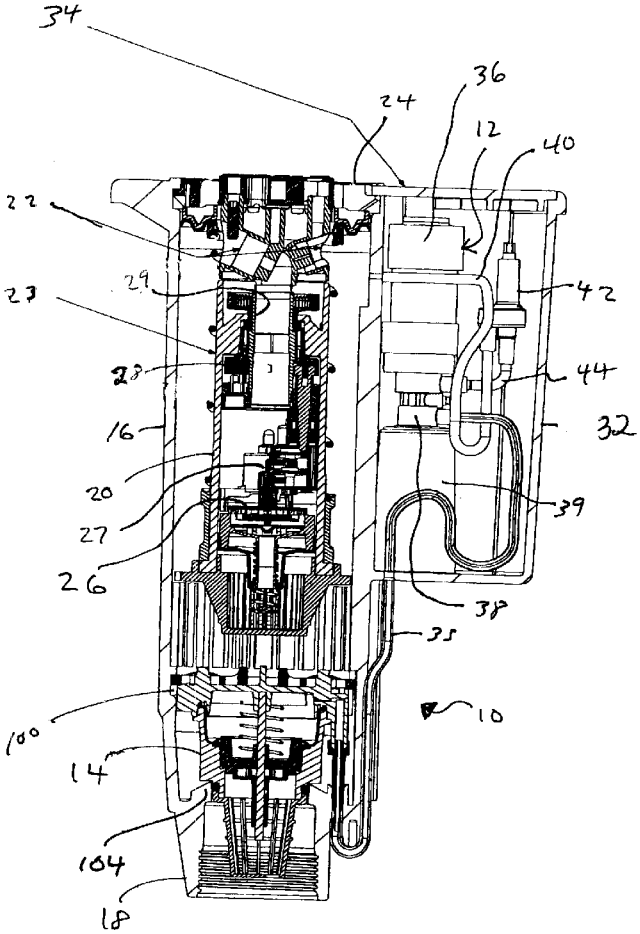
FIG. 4 is a vertical sectional view of the sprinkler of FIG. 1 taken along line 4—4 of FIG. 2.
Figure 5:
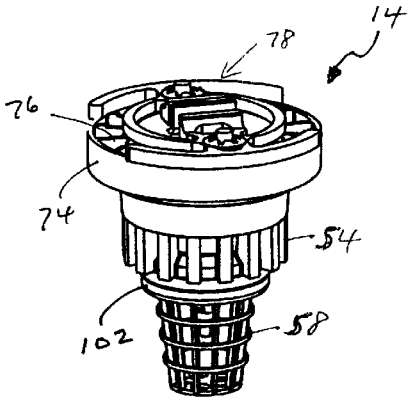
FIG. 5 is an enlarged perspective view of the diaphragm valve module of the sprinkler of FIGS. 1–4.
Figure 8:
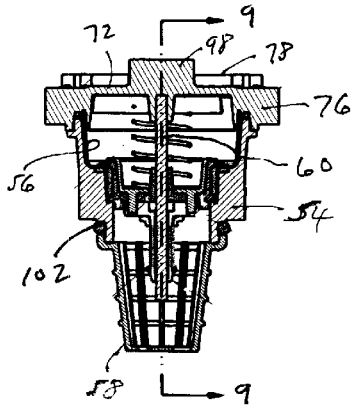
FIG. 8 is a vertical sectional view of the diaphragm valve module taken along line 8—8 of FIG. 7.
Figure 6:
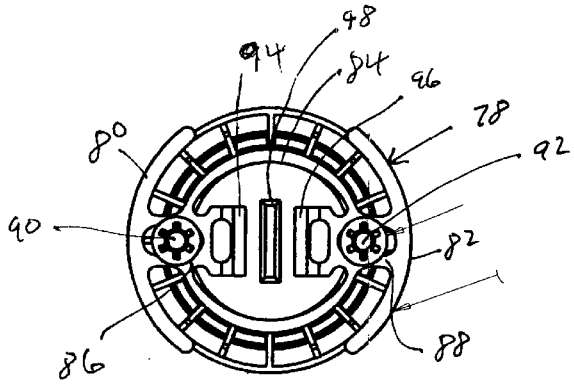
FIG. 6 is a top plan view of the diaphragm valve module of FIG. 5 showing its snap ring.
Figure 9:
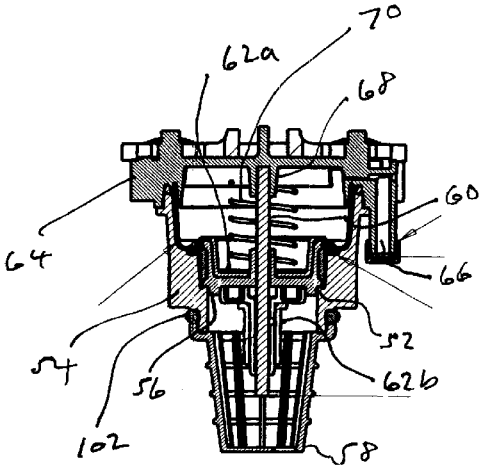
FIG. 9 is a vertical sectional view of the diaphragm valve module taken along line 9—9 of FIG. 8.

FIG. 1 illustrates a pop-up sprinkler 10 incorporating a surface accessible valve actuator component assembly 12 (FIG. 2) and a top serviceable diaphragm valve module 14 (FIG. 5). Unless otherwise indicated, the parts of the sprinkler 10 are generally made of rigid molded plastic. The sprinkler 10 includes a vertically extending generally cylindrical hollow outer housing 16 (FIG. 4) having a female threaded inlet 18 at its lower end. The diaphragm valve module 14 is located in the lower end of the main housing 16 for admitting water through the inlet 18 into the interior of the housing 16. A tubular riser 20 is vertically reciprocable within the interior of the housing 16 when the housing 16 is connected to a source of pressurized water (not shown) and the diaphragm valve module 14 is opened and closed.

A cylindrical nozzle head 22 (FIG. 4) including a conventional nozzle is mounted at an upper end of the riser 20. The riser 20 is held in its retracted position by a riser retraction spring 23 that surrounds the riser 20 and is held in place by a split containment ring 24 snapped into a groove in the upper end of the housing 16. If desired, the containment ring 24 could be the co-molded type disclosed in U.S. Pat. No. 6,082,632, the entire disclosure of which is hereby incorporated by reference. The riser 20 also contains a water driven turbine 26 mounted within the riser 20 and coupled to the nozzle head 22 through a gear train 27, an arc adjustment and reversing mechanism 28 and a drive shaft 29 for rotating the nozzle back and forth through an adjustable arc. Oscillating arc adjustable turbine driven nozzle rotating mechanisms are well known in the sprinkler art and need not be described herein in detail. See for example U.S. Pat. No. 5,720,435 of Richard E. Hunter, granted Feb. 24, 1998, the entire disclosure of which is hereby incorporated by reference. An impact drive spray head with a nozzle that is mounted on a vertically reciprocable riser could be used in place of the rotor type riser 20. See for example, U.S. Pat. No. 5,971,156 granted Feb. 16, 1999, the entire disclosure of which is hereby incorporated by reference.

Figure 3:
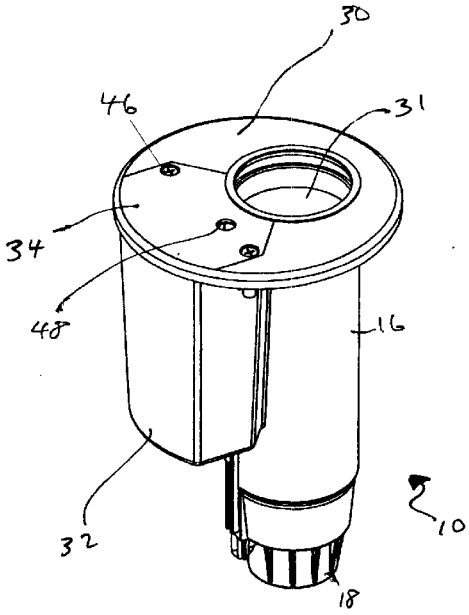
FIG. 3 is a reduced perspective view of the sprinkler of FIG. 1 with the riser removed to show the opening in the upper end of its outer housing.

A circular ground support flange 30 (FIGS. 1–3) extends horizontally and radially outwardly from the upper end of the housing 16. The ground support flange 30 has an off-center riser opening 31 (FIG. 3) that communicates with the upper end of the housing 16 and through which the riser 20 extends. The opening 31 is also circular but it is eccentrically located with respect to the circular ground support flange 30. A generally rectangular valve actuator component assembly housing 32 (FIGS. 1–4) is connected to an exterior side of the housing 16. Preferably the housing 32 is integrally molded to the housing 16. The housing 32 has an openable lid 34 that aligns with, and effectively forms a part of, the ground support flange 30 when the lid 34 is in its closed position. Preferably the lid 34 does not extend beyond the periphery of the circular ground support flange 30. A groove for the split containment ring 24 extends along the upper end of the outer wall of the housing 32. It is desirable that the ground support flange 30 be circular and that the housing 32 not extend beyond the periphery of the flange 30. This allows maintenance personnel to cut a circular hole in turf with conventional equipment to accommodate the ground support flange 30.

As best seen in FIG. 4, the valve actuator component assembly 12 is mounted in the valve actuator component assembly housing 32. The assembly 12 is connected via hose 35 to the diaphragm valve module 14 for opening and closing the diaphragm valve module 14. The valve actuator component assembly 12 includes a solenoid 36 and a pilot valve 38. The pilot valve 38 sits on a top of a shoulder or stand-off 39 molded into the bottom of the housing 32. Preferably the pilot valve 38 is locked to the stand-off 39 via a bayonet locking mechanism not fully visible in FIG. 4. A hose 40 connects to a fitting (not visible) on the side of the housing 16 and to a first side of an adjustable pressure regulator 42. Another hose 44 connects a second side of the pressure regulator 42 to the pilot valve 38. The critical parts 36, 38 and 42 of the valve actuator component assembly 12 are readily accessible from above a surface of a bed of soil (not illustrated) in which the housing 16 is planted upon moving the lid 34 to an open position. The lid 34 is removable entirely from the sprinkler 10 by removing screws 46 (FIG. 3) that are screwed into bores in the housing 32. Yardage numerals for a golf fairway may be engraved into the lid 34. Alternatively, the lid 34 can be molded with different yardage numerals thereon. A hole 48 in the lid 34 allows a tool (not shown) to be inserted into the housing 32 to engage the valve actuator component assembly 12 to manually turn the diaphragm valve module 14 to its ON, AUTOMATIC and OFF states.

Figure 7:
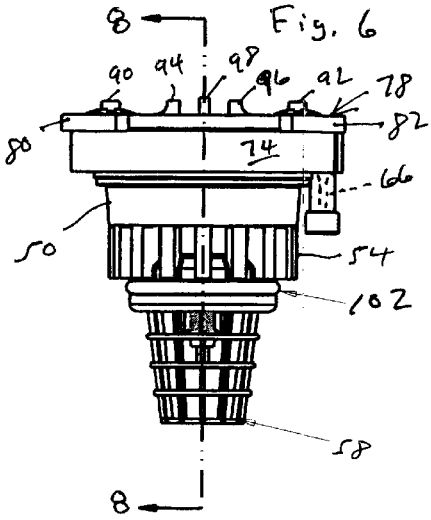
FIG. 7 is a side elevation view of the diaphragm valve module of FIG. 5.
Figure 10:
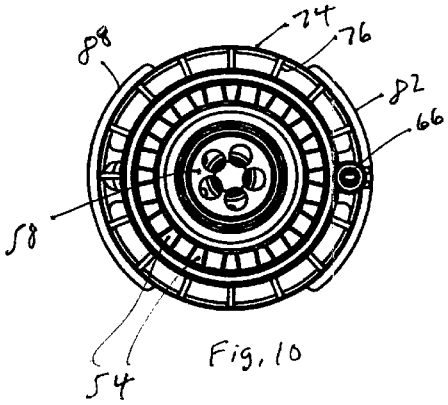
FIG. 10 is a bottom plan view of the diaphragm valve module of FIG. 5.

Referring to FIGS. 5–10, the diaphragm valve module 14 is specially configured for removal as a unit from the pop-up sprinkler 10 through the opening 31. The diaphragm valve module 14 includes a cylindrical valve body 50 (FIG. 7) and a generally cylindrical valve seat 52 (FIG. 9) connected to the valve body 50 by a plurality of axially extending, circumferentially spaced ribs 54 (FIG. 7). An elastomeric cylindrical valve member 56 (FIG. 9) is supported by the valve body 50. The valve member 56 is made of a pliant transparent plastic material. The valve member 56 has a portion that engages and disengages the valve seat 52 to permit water to flow through the ribs 54 and around the valve body 50. A conical filter screen 58 is connected to the underside of the valve seat 52 for prevent large debris from contacting a metal metering pin 60 (FIGS. 8 and 9) that extends through a metering plate assembly made of upper and lower parts 62*a* and 62*b* (FIG. 9) that sandwich the lower central flat portion of the valve member 56. A cover 64 fits over the upper end of the valve body 50 and includes a pilot valve passage 66. The upper end of the metering pin 60 seats in a socket 68 formed in the underside of the cover 64. A coil spring 70 is compressed between the upper metering plate part 62*a* and the underside of the cover 64. The valve member 56 is of the rolling diaphragm type which deforms to disengage the valve seat 52 and permit the passage of water through the inlet 18 to the riser 20. This occurs when the pilot valve 38 is actuated by the solenoid 36 to vent pressure from the backside (upper side) of the valve member 56 via hose 35 and pilot valve passage 66. The cover 64 has a central portion 72 (FIG. 8), an outer annular portion 74 (FIG. 5) and a plurality of radially extending, circumferentially extending fins 76 (FIG. 10) that connect the central portion 72 of the cover 64 to the outer annular portion 74 defining water flow passages therebetween.

A radially retractable and expandable snap ring 78 (FIG. 6) is mounted to the cover 64 for releasably holding the diaphragm valve module 14 in its operative position in the lower end of the outer housing 16. The snap ring 78 has a pair of opposing peripheral annular portions 80 and 82 that are joined by a circular central portion 84. The peripheral annular portions 80 and 82 are formed as arcuate segments. The central portion 84 is resilient and deformable so that it can be squeezed to radially retract the annular portions 80 and 82 toward each other. The peripheral annular portions 80 and 82 and the central portion 84 are connected by oppositely extending guide portions 86 and 88 having slots that can each slidingly receive corresponding anchor pins 90 and 92, respectively. The anchor pins 90 and 92 extend from the top side of the cover 64. The anchor pins 90 and 92 could be metal pins, screws or rivets, molded projections or any other expedient attachment device. The central portion 84 has a pair of opposing vertically extending tab portions 94 and 96 that can be squeezed together to radially retract the annular portions 80 and 82. A flange 98 (FIG. 8) extends vertically from the top center of the cover 64 and limits the inward movement of each of the tab portions 94 and 96 to ensure that the annular portions 80 and 82 are retracted equal radial distances.

Thus, with the riser 20 removed from the outer housing 16, a pair of needle nose pliers can be used to squeeze the tab portions 94 and 96 together to thereby pull the peripheral annular portions 80 and 82 out of an annular groove 100 (FIG. 4) formed in the interior wall of the outer housing 16 of the sprinkler 10. At this time, the central portion 84 of the snap ring 78 has been deformed from a circular shape to an oval shape. This allows the valve module 14 to be lifted out of the housing 16 through the opening 31. During re-insertion of the valve module 14, the same pliers are used to hold the tab portions 94 and 96 together while the valve module 14 is placed in the lower end of the housing 16. The tab portions 94 and 96 are then released and the central portion 84 returns to its true circular shape due to its resilience, forcing the peripheral annular portions 80 and 82 into the surrounding groove in the housing 16. This firmly anchors and holds the valve module 14 in position in the lower end of the sprinkler 10. Clearly the maximum outer dimension of the diaphragm valve module 14 must be less than the smallest inner dimension of the central bore of the outer cylindrical housing 16 of the sprinkler 10 to permit insertion and withdrawal of the diaphragm valve module 14. An elastomeric O-ring 102 (FIGS. 7 and 8) surrounds the outside of the valve seat 52 and engages an interior shoulder 104 (FIG. 4) of the lower end of the cylindrical outer housing 16. The O-ring 102 provides a watertight seal between the diaphragm valve module 14 and the housing 16 at the female threaded inlet 18.

Thus the present invention provides a labor saving sprinkler that permits repairs to its valve actuator component assembly and its diaphragm valve module to be easily made without having to excavate the sprinkler 10. While a preferred embodiment of our pop-up sprinkler with a top serviceable diaphragm valve module has been described in detail, it will be understood by those skilled in the art that our invention may be modified in both arrangement and detail. For example, our invention may be used with sprinklers other than the pop-up type. The invention can also be adapted for use with impact drive spray heads. The configuration of the outer housing 16, valve actuator component assembly 12 and the diaphragm valve module 14 can be widely varied. Therefore the protection afforded our invention should only be limited in accordance with the scope of the following claims.

What is claimed is:

1. A top serviceable pop-up sprinkler, comprising:

an outer housing having an inlet at a lower end thereof;

a riser mounted inside the outer housing for vertical reciprocation through an opening in an upper end of the outer housing;

a nozzle mounted in an upper end of the riser for ejecting a stream of water;

at least one valve actuator component connected to the outer housing; and a diaphragm valve module mounted in the lower end of the outer housing for controlling the flow of water through the inlet in response to actuation of the valve actuator component, the diaphragm valve module being removable as a unit from the outer housing through the opening in the upper end of the outer housing upon removal of the riser from the outer housing.

2. The sprinkler of claim 1 wherein the diaphragm valve module includes means for releasably holding the diaphragm valve module in an operative position in the lower end of the outer housing.

3. The sprinkler of claim 2 wherein the holding means comprises a radially retractable and expandable snap ring.

4. The sprinkler of claim 3 wherein the snap ring has a pair of opposing peripheral annular portions that are joined by a central portion that can be squeezed to radially retract the annular portions.

5. The sprinkler of claim 1 wherein the diaphragm valve module includes a valve body, a valve seat connected to the valve body by a plurality of axially extending, circumferentially spaced ribs, and an elastomeric valve member supported by the valve body that has a portion that engages and disengages the valve seat to permit water to flow through the ribs and around the valve body.

6. The sprinkler of claim 5 wherein the valve module has a screen connected to the valve seat.

7. The sprinkler of claim 5 wherein the valve module has a cover that fits over the valve body and includes a pilot valve passage.

8. The sprinkler of claim 7 wherein a radially retractable and expandable snap ring is mounted to the cover for holding the diaphragm valve module in an operative position in the lower end of the outer housing.

9. The sprinkler of claim 7 wherein the cover has a central portion, an outer annular portion and a plurality of radially extending, circumferentially extending fins that connect the central portion of the cover to the outer annular portion of the cover to define water flow passages.

10. The sprinkler of claim 1 wherein the riser includes a turbine driven by water flowing through the riser, a gear train coupled to the turbine, and an arc adjustment and reversing mechanism connecting the gear train to a drive shaft connected to the nozzle.

11. A top serviceable pop-up sprinkler, comprising:

an outer housing having an inlet at a lower end thereof;

a riser mounted inside the outer housing for vertical reciprocation through an opening in an upper end of the outer housing:

a nozzle mounted in an upper end of the riser for ejecting a stream of water;

at least one valve actuator component supported by the outer housing; and a diaphragm valve module mounted in the lower end of the outer housing and connectable to the valve actuator component for controlling the flow of water through the inlet in response to actuation of the valve actuator component, the diaphragm valve module being removable as a unit from the outer housing through the opening in the upper end of the outer housing upon removal of the riser from the outer housing.

12. The sprinkler of claim 11 wherein the diaphragm valve module includes means for releasably holding the diaphragm valve module in an operative position in the lower end of the outer housing.

13. The sprinkler of claim 12 wherein the holding means comprises a radially retractable and expandable snap ring.

14. The sprinkler of claim 11 wherein the valve actuator component is a pilot valve.

15. The sprinkler of claim 14 wherein a hose connects the pilot valve to a pilot valve passage in the diaphragm valve module when the diaphragm valve module in an operative position in the lower end of the outer housing.

16. The sprinkler of claim 11 wherein the diaphragm valve module includes a valve body, a valve seat connected to the valve body, and an elastomeric valve member supported by the valve body that has a portion that engages and disengages the valve seat to permit water to flow around the valve body.

17. The sprinkler of claim 11 wherein the valve module includes a screen.

18. The sprinkler of claim 11 wherein the valve module includes a pilot valve passage.

19. The sprinkler of claim 11 wherein the valve actuator component is a solenoid actuated pilot valve and the sprinkler further comprises a pressure regulator connected to the pilot valve.

20. The sprinkler of claim 11 wherein the riser includes a turbine driven by water flowing through the riser, a gear train coupled to the turbine, and an arc adjustment and reversing mechanism connecting the gear train to a drive shaft connected to the nozzle.

* * * * *